US010859090B2

(12) United States Patent
Jang et al.

(10) Patent No.: US 10,859,090 B2
(45) Date of Patent: Dec. 8, 2020

(54) WATER PUMP

(71) Applicant: NEW MOTECH CO., LTD., Gwangju (KR)

(72) Inventors: Jeong Cheol Jang, Gwangju (KR); Ji Min Lee, Gwangju (KR); Seong Jin Lee, Naju-si (KR)

(73) Assignee: NEW MOTECH CO., LTD., Gwangju (KR)

( * ) Notice: Subject to any disclaimer, the term of this patent is extended or adjusted under 35 U.S.C. 154(b) by 69 days.

(21) Appl. No.: 16/331,143

(22) PCT Filed: Sep. 18, 2017

(86) PCT No.: PCT/KR2017/010181
§ 371 (c)(1),
(2) Date: Mar. 7, 2019

(87) PCT Pub. No.: WO2018/084428
PCT Pub. Date: May 11, 2018

(65) Prior Publication Data

US 2019/0234417 A1 Aug. 1, 2019

(30) Foreign Application Priority Data

Nov. 3, 2016 (KR) ..... 10-2016-0145498

(51) Int. Cl.
*F04D 29/20* (2006.01)
*F04D 29/22* (2006.01)
(Continued)

(52) U.S. Cl.
CPC ..... *F04D 29/20* (2013.01); *F01P 5/10* (2013.01); *F04D 13/021* (2013.01); *F04D 13/06* (2013.01);
(Continued)

(58) Field of Classification Search
CPC ..... F01P 5/10; F04D 13/021; F04D 13/06; F04D 13/064; F04D 29/04; F04D 29/044;
(Continued)

(56) References Cited

U.S. PATENT DOCUMENTS 6,663,362 B1 * 12/2003 Lentz ..... H02K 1/145 417/423.7
7,074,019 B2 * 7/2006 Knoll ..... H02K 1/272 123/41.44
(Continued)

FOREIGN PATENT DOCUMENTS

KR 10-2009-0031303 A 3/2009
KR 10-2011-0055277 A 5/2011
(Continued)

OTHER PUBLICATIONS

International Search Report for PCT/KR2017/010181 dated Dec. 22, 2017 from Korean Intellectual Property Office.

*Primary Examiner* — Patrick Hamo
*Assistant Examiner* — Joseph S. Herrmann
(74) *Attorney, Agent, or Firm* — Revolution IP, PLLC

(57) ABSTRACT

A water pump includes: an upper housing formed with an inlet and an outlet of fluid; a lower housing installed to fit in a lower side of the upper housing, having a receiving space formed therein; a shaft fixing support having a lower part of a protrudedly formed shaft inserted in the center of a bottom part of the lower housing; an impeller installed around the shaft; a rotor configured by having a magnet installed around a rotor core; a stator installed inside the lower housing; a lower cover; a shaft upper part fixing support member installed in an upper side of the shaft erectedly inserted in the shaft fixing support; and a synthetic resin mold member formed with a first synthetic resin mold around an outer side
(Continued)

of the shaft fixing support and around the shaft, and a second synthetic resin mold around an outer side of the rotor.

6 Claims, 5 Drawing Sheets

(51) Int. Cl.

| | |
|---|---|
| ***F04D 29/04*** | (2006.01) |
| ***F04D 13/06*** | (2006.01) |
| ***F04D 29/60*** | (2006.01) |
| ***F04D 29/42*** | (2006.01) |
| ***F01P 5/10*** | (2006.01) |
| ***F04D 29/62*** | (2006.01) |
| ***F04D 13/02*** | (2006.01) |
| ***F04D 29/044*** | (2006.01) |

(52) U.S. Cl.
CPC ..... *F04D 13/064* (2013.01); *F04D 29/04* (2013.01); *F04D 29/044* (2013.01); *F04D 29/2222* (2013.01); *F04D 29/426* (2013.01); *F04D 29/605* (2013.01); *F04D 29/628* (2013.01)

(58) Field of Classification Search
CPC .... F04D 29/20; F04D 29/2222; F04D 29/426; F04D 29/605; F04D 29/628; H02K 7/086
See application file for complete search history.

(56) References Cited

U.S. PATENT DOCUMENTS

| | | | | |
|---|---|---|---|---|
| 7,679,252 | B2 * | 3/2010 | Iwase | H02K 1/276 310/156.53 |
| 7,839,046 | B2 * | 11/2010 | Hashimoto | H02K 5/128 310/257 |
| 8,476,795 | B2 * | 7/2013 | Wakabayashi | F04D 13/064 310/68 B |
| 8,696,333 | B2 * | 4/2014 | Ishiguro | F04D 13/0626 417/423.7 |
| 10,291,091 | B2 * | 5/2019 | Moritz | H02K 5/128 |
| 10,415,566 | B2 * | 9/2019 | Ramadoss | F04C 2/18 |
| 2009/0081059 | A1 * | 3/2009 | Seki | F04D 13/064 417/420 |
| 2011/0116954 | A1 | 5/2011 | Hong et al. | |
| 2017/0082117 | A1 * | 3/2017 | Zhou | F04D 29/5813 |

FOREIGN PATENT DOCUMENTS

| | | | |
|---|---|---|---|
| KR | 10-2012-0053779 | A | 5/2012 |
| KR | 10-2012-0057008 | A | 6/2012 |
| KR | 10-1527529 | B1 | 6/2015 |

* cited by examiner

[Fig. 1]
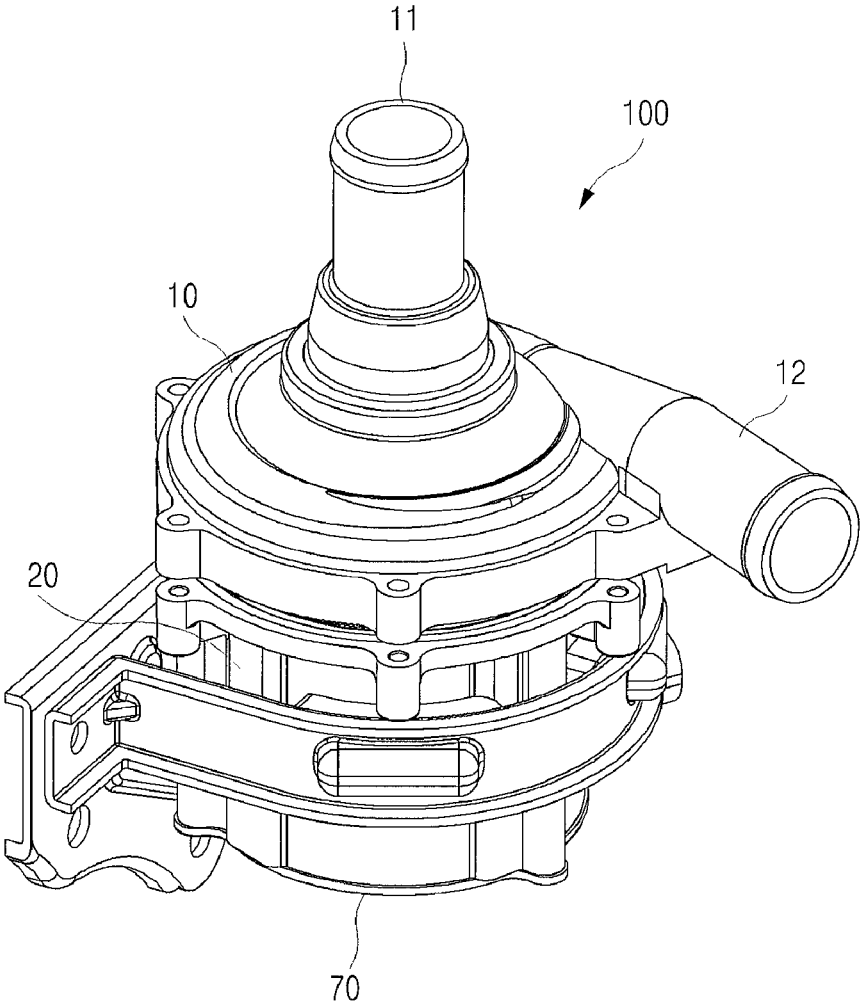

[Fig. 2]
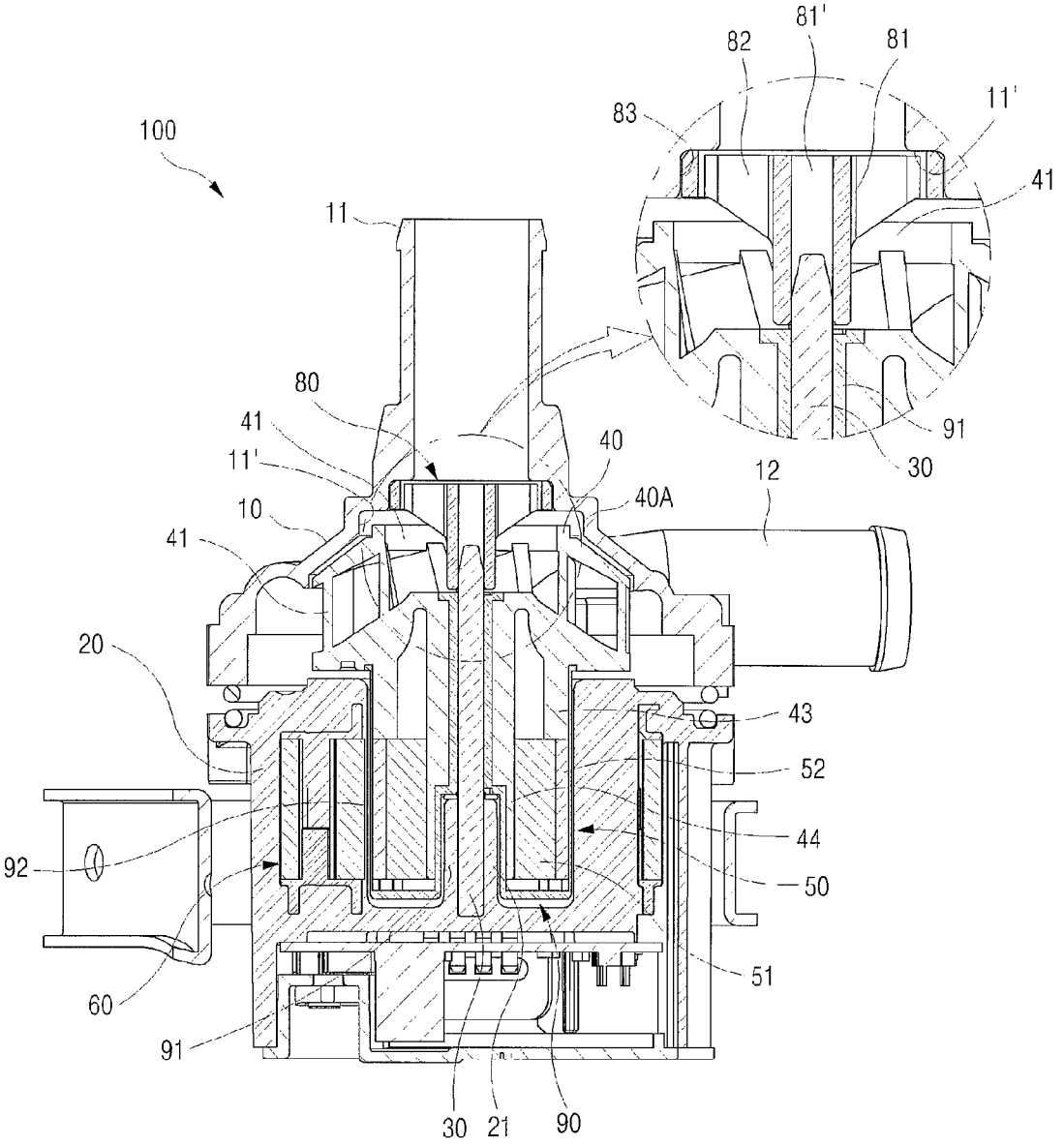

[Fig. 3]
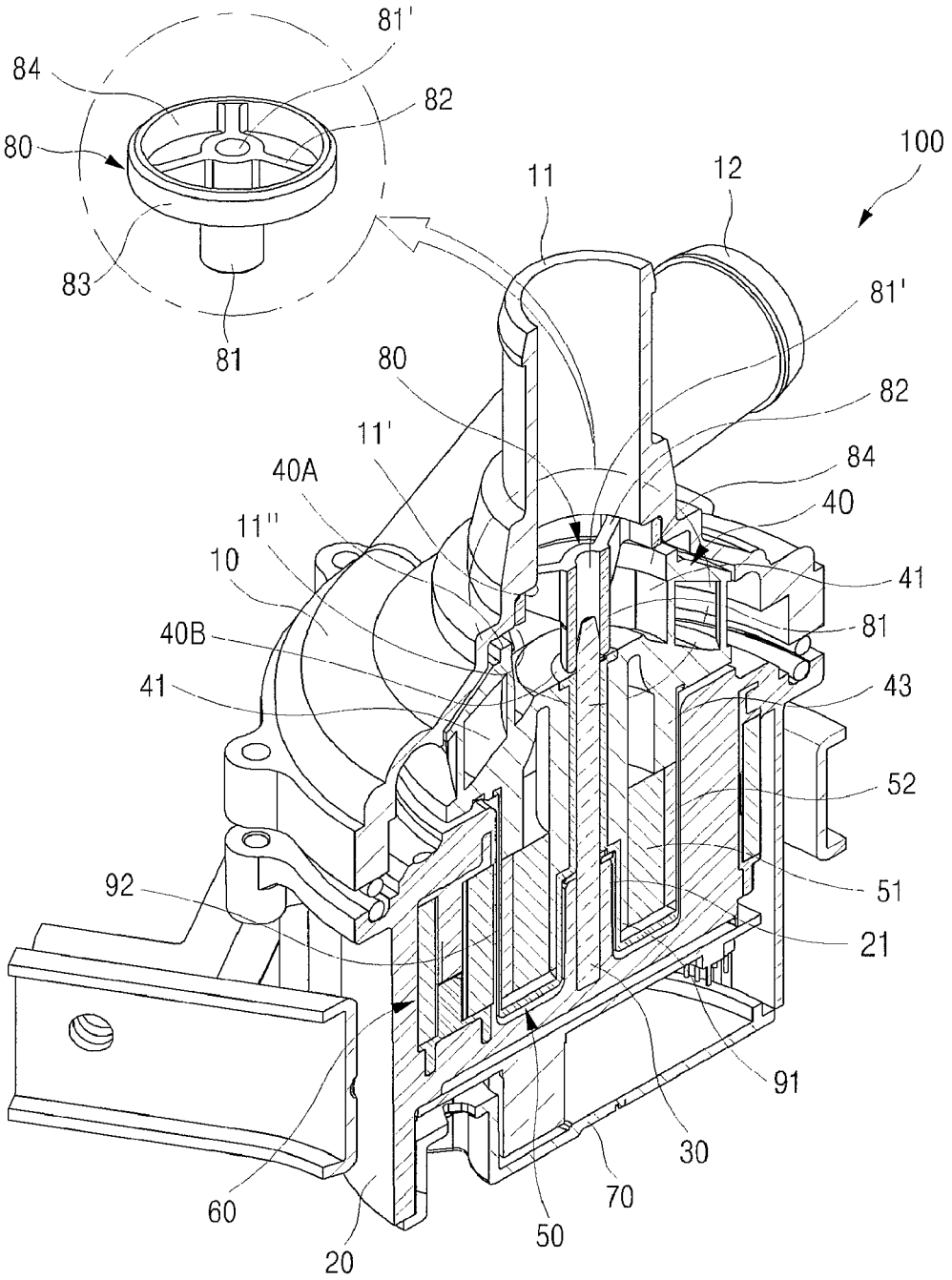

[Fig. 4]
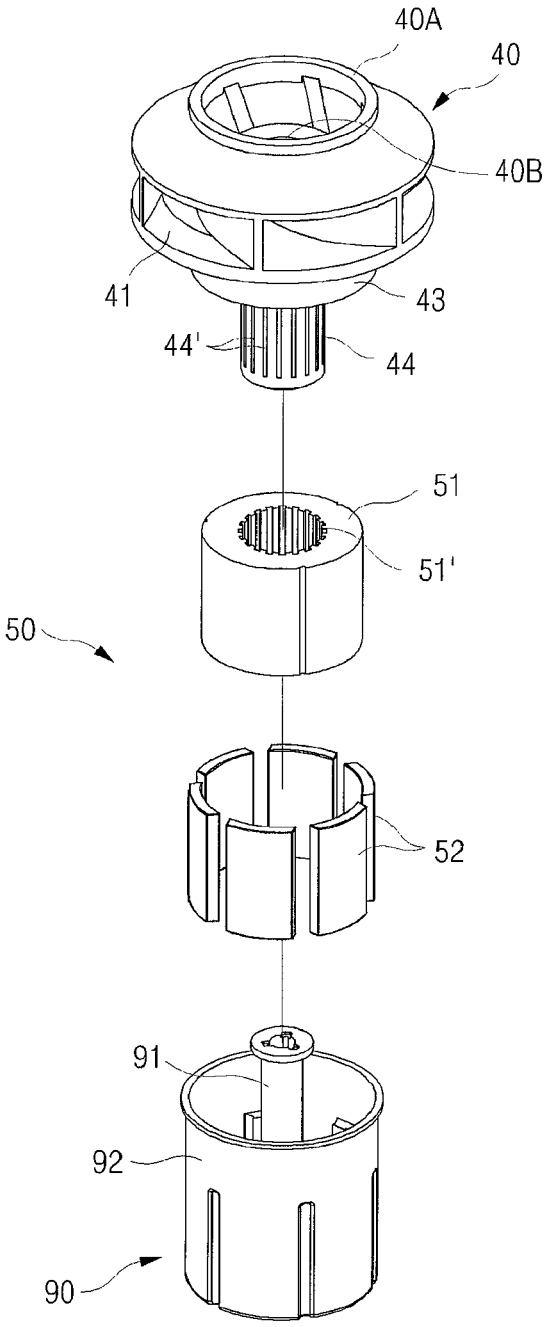

[Fig. 5]
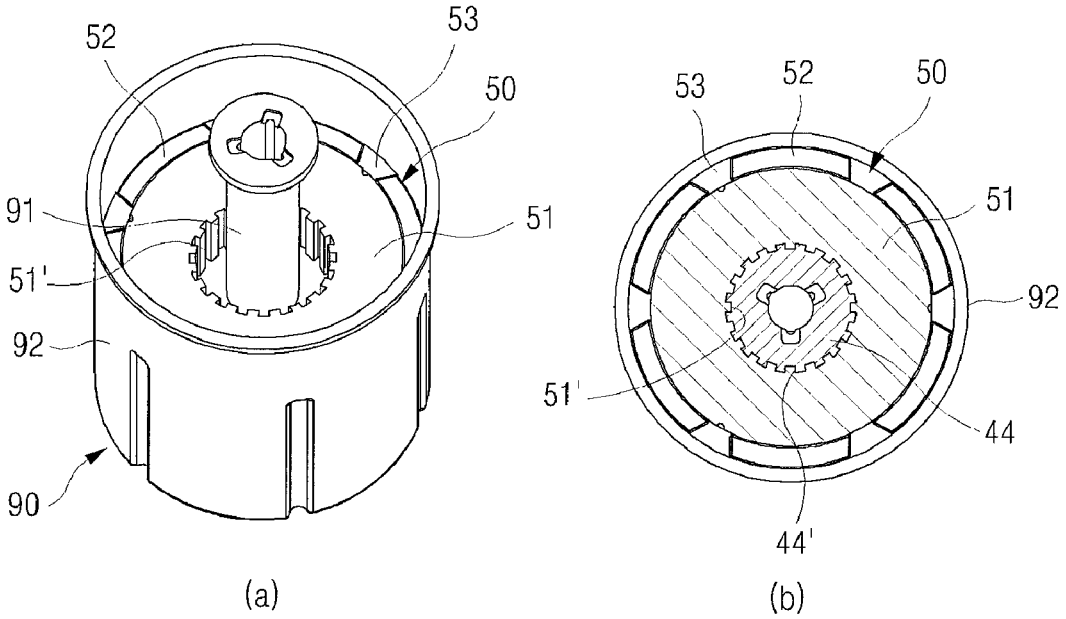

WATER PUMP

TECHNICAL FIELD

The present invention relates to a water pump. More specifically, the present invention relates to a water pump enabling simultaneous rotation of a rotor and an impeller in a state fixing a shaft more firmly, thereby miniaturizing the pump and greatly improving durability.

BACKGROUND ART

In general, a water pump for stably circulating indoor hot water is installed in heating equipment such as a hot-water mat. Such water pumps allow hot water to circulate by rotating the impeller connected to the rotor when the rotor rotates by a magnetic field generated from the stator in a state having the impeller in the upper part connected by shaft coupling to a rotor made of a permanent magnet.

Korean Patent Laid-Open No. 10-2011-0055277 discloses an electric water pump wherein an impeller is installed at a shaft end installed in the middle of a rotor rotating by a stator, so that the rotor rotates while being affected by the magnetic field generated from the stator, thereby allowing circulation of the cold water while rotating the impeller installed at the rotor end. However, there is a problem that it is difficult to miniaturize such water pump because the impeller and rotor are configured separately. Also, since a bearing for rotating the shaft and a sealing structure for preventing leakage, etc. are required, there is a problem that the constitution of the pump is very complex, thereby causing increase of manufacturing cost.

DISCLOSURE OF INVENTION

Technical Problem

The present invention aims at simplifying the assembly of a water pump, so as to miniaturize the pump.

Also, the present invention aims at firmly installing the pump without rotating a shaft, so as to improve the durability of the pump.

Solution to Problem

The present invention is characterized by a water pump 100, comprising: an upper housing 10 formed with an inlet 11 and an outlet 12 of fluid; a lower housing 20 installed to fit in a lower side of the upper housing 10, having a receiving space formed therein; a shaft fixing support 21 having a lower part of a protrudedly formed shaft 30 inserted in the center of a bottom part of the lower housing 20; an impeller 40 installed around the shaft 30; a rotor 50 configured by having a magnet 52 installed around a rotor core 51; a stator 60 installed inside the lower housing 20; a lower cover 70; a shaft upper part fixing support member 80 installed in an upper side of the shaft 30 erectedly inserted in the shaft fixing support 21; and a synthetic resin mold member 90 formed with a first synthetic resin mold 91 around an outer side of the shaft fixing support 21 and around the shaft 30, and a second synthetic resin mold 92 around an outer side of the rotor 50.

In the present invention, preferably, an upper side of the shaft 30 is insertedly fixed in an insertion hole 81' of a middle insertion part 81 of the shaft upper part fixing support member 80 while a lower side of the shaft 30 is insertedly fixed in the shaft fixing support 21.

In the present invention, preferably, the shaft upper part fixing support member 80 comprises: a middle insertion part 81 formed with an insertion hole 81' in the center and downwardly prolonged; a reinforcing piece 82 installed at certain intervals around an upper part of the middle insertion part 81; an insertion ring frame 83 integrally formed by connecting the outer side of each reinforcing piece 82; and a fluid passing hole 84 between the reinforcing piece 82 and the reinforcing piece 82.

In the present invention, preferably, an edge of the insertion ring frame 83 is fixedly installed by being inserted in an inner side step 11' of the inlet 11.

In the present invention, preferably, the rotor core 51 is insertedly fixed in a rotation shaft 44 installed in a lower part of a cylindrical reinforcing part 43 downwardly integrated to a lower part of the impeller 40, and a magnet 52 is installed at certain intervals on a circumferential surface of the rotor core 51 while wrapping and fixing the magnet 52 with the second synthetic resin mold 92, so as to combine the impeller 40 and the rotor 50.

In the present invention, preferably, the water pump may be configured by combining an insertion groove 44' of a concavo-convex shape formed on a circumferential surface of the rotation shaft 44 of the impeller 40 and an insertion protrusion 51' of a concavo-convex shape formed inside the rotor core 51 with each other.

Advantageous Effects of Invention

The present invention can miniaturize the size of the pump by combining the impeller and the rotor without separating them, and accordingly water pumps for vehicles having a small space can be installed easily and conveniently. Also, the present invention allows the rotor to rotate being affected by the magnetic field generated from the stator, regardless of the rotation of the shaft, and accordingly the rotation force of the impeller can be greatly improved, thereby increasing the efficiency of the water pump.

Further, the present invention provides a shaft in a state where the upper part, lower part and circumference of the shaft are firmly fixed, and thus improves the durability of the pump, and the bearing and sealing structure, etc. required when rotating the shaft are unnecessary, and thus the manufacturing cost of the pump can be greatly saved.

BRIEF DESCRIPTION OF DRAWINGS

FIG. 1 is perspective view of the water pump according to the present invention;

FIG. 2 is a cross-sectional view of the water pump according to the present invention;

FIG. 3 is a perspective view cutting away the water pump according to the present invention;

FIG. 4 is a perspective view excerpting the main part of the water pump according to the present invention; and FIG. 5 are views for explaining a synthetic resin mold of the water pump according to the present invention; (a) is a perspective view and (b) is a cross-sectional plan view of the installation condition.

MODE FOR THE INVENTION

FIG. 1 is a perspective view of an overall combination of the present invention, FIG. 2 is a longitudinal cross-sectional view of the present invention, FIG. 3 is a cut-away perspective view of the present invention, FIG. 4 is a perspective view excerpting the main part of the impeller and the rotor of the present invention, and FIG. 5 are views for explaining the synthetic resin mold of the present invention wherein (a) is a perspective view and (b) is a cross-sectional plan view of the installation condition, which are the drawings for explaining the embodiment of the present invention.

The present invention is configured by a water pump 100, comprising: an upper housing 10 formed with an inlet 11 and an outlet 12 of fluid; a lower housing 20 installed to fit in a lower side of the upper housing, having a receiving space formed therein; a shaft fixing support 21 having a lower part of a protrudedly formed shaft 30 inserted in the center of a bottom part of the lower housing 20; an impeller 40 installed around the shaft 30; a rotor 50 configured by having a magnet 52 installed around a rotor core 51; a stator 60 installed inside the lower housing 20; a lower cover 70; a shaft upper part fixing support member 80 installed in an upper side of the shaft 30 erectedly inserted in the shaft fixing support 21; and a synthetic resin mold member 90 formed by having a first synthetic resin mold 91 inserted around an outer side of the shaft fixing support 21 and around the shaft 30, and a second synthetic resin mold 92 inserted around an outer side of the rotor 50.

In particular, the present invention is configured to allow the impeller 40 to rotate freely by the rotation of the rotor 50 in a state having the shaft 30 fixed, so as to fix the upper part and the lower part of the shaft 30 firmly. By this purport, in the present invention, a bearing, etc. which is a constitutional element essential for the rotation of the shaft 30 is unnecessary.

Also, in order to miniaturize the pump, the present invention provides the impeller 40 and the rotor 50 to be combined with each other, not separated.

To this end, in the present invention, an upper side of the shaft 30 is insertedly fixed in an insertion hole 81' of a middle insertion part 81 of a shaft upper part fixing support member 80 while a lower side of the shaft 30 is insertedly fixed in the shaft fixing support 21, thereby allowing the shaft 30 to be fixed and maintained firmly without shaking while driving the motor.

The shaft upper part fixing support member 80 comprises a middle insertion part 81 formed with an insertion hole 81' in the center and downwardly prolonged, a reinforcing piece 82 installed at certain intervals around an upper part of the middle insertion part 81, an insertion ring frame 83 integrally formed by connecting the outer side of each reinforcing piece 82, and a fluid passing hole 84 between the reinforcing piece 82 and the reinforcing piece 82. The edge of the insertion ring frame 83 is fixedly installed by being inserted in an inner side step 11' of the inlet 11, and the fluid passing hole 84 is installed to be interconnected with the fluid inlet (wing part) 41 of the impeller 40. The impeller 40, the shaft upper part fixing support member 80 and the shaft 30 may be installed to be separated from each other in minute gaps, without disturbing the rotation of the impeller 40.

That is, by configuring an upper part edge 40A of the impeller 40 to be located in a step 11" in a lower end inside the inlet 11, and inserting the middle insertion part 81 of the shaft upper part fixing support member 80 to be separated from the inner circumference of a shaft insertion hole 40B of the impeller 40, the shaft upper part fixing support member 80 can be supported in a state having the shaft 30 inserted, and fixed in a state having the edge of the insertion ring frame 83 hung on the inner side step 11', so that the impeller 40 can rotate with respect to the shaft 30 regardless of the shaft upper part fixing support member 80.

Therefore, since the shaft 30 is fixedly installed in a firm state, the rotor 50 can rotate without eccentricity, and the impeller 40 can rotate by the rotation of the rotor 50 regardless of the shaft 30. Therefore, it became possible for the impeller 40 to rotate lightly than a weight where the shaft, rotor and impeller rotate at the same time as in prior art, and thus the rotation force of the impeller 40 can be greatly improved. In addition, the fluid introduced from the inlet 11 while the impeller 40 rotates is discharged to the outlet 12 through the inlet 41 of the impeller 40 interconnected with the fluid passing hole 83, and thus the flow of fluid is not interrupted even if the shaft upper part fixing support member 80 is installed in the upper side of the impeller 40.

Further, as mentioned in the above, the impeller 40 and the rotor 50 are provided in a combined state, not separated, so that the impeller 40 can rotate at the same time as the rotor 50 rotates. The rotor core 51 is insertedly fixed in the rotation shaft 44 installed in a lower part of a circular reinforcing part 43 downwardly integrated to a lower part of the impeller 40, and the magnet 52 is installed at certain intervals on a circumferential surface of the rotor core 51 while wrapping and fixing the magnet with the second synthetic resin mold 92, so as to combine the impeller 40 and the rotor 50. The insertion groove (or insertion protrusion) 44' of a concavo-convex shape formed on a circumferential surface of the rotation shaft 44 of the impeller 40 and an insertion protrusion (or insertion groove) 51' of a concavo-convex shape formed inside the rotor core 51 are combined with each other to be combined in a firm state. The circumference of the shaft 30 and the first synthetic resin mold 91 are separate from each other in minute gaps, so that the rotor 50 can rotate in a state where the shaft 30 is fixed.

Therefore, the rotor core 51 fixedly installed with the magnet 51 and the impeller 40 allow the insertion protrusion 51' of the rotor core 51 and the insertion groove 44' of the rotation shaft 44 of the impeller 40 to be combined with each other and maintained in a firm state, thereby allowing the rotor 50 to rotate regardless of the shaft 30 in correspondence to and in reaction to the magnetic field generated from the stator 60 so that the impeller 40 combined with the rotor 50 rotates while accomplishing target circulation of fluid.

Although the present invention is described as above with reference to drawings and embodiments, the present invention is not limited by specific embodiments, and it should be interpreted that various modifications and changes can be made by a person skilled in the art within a scope not deviating from the scope of the present invention. Also, the drawings are illustrated to better understand the invention, and it should not be interpreted that the drawings limit the claims.

The invention claimed is:

1. A water pump (100), comprising:

an upper housing (10) formed with an inlet (11) and an outlet (12) of fluid;

a lower housing (20) installed to fit in a lower side of the upper housing (10), having a receiving space formed therein; a shaft fixing support (21) having a lower part of a protrudedly formed shaft (30) inserted in the center of a bottom part of the lower housing (20);

an impeller (40) installed around the shaft (20);

a rotor (50) configured by having a magnet (52) installed around a rotor core (51);

a stator (60) installed inside the lower housing (20);

a lower cover (70);

a shaft upper part fixing support member (80) installed in an upper side of the shaft (30) erectedly inserted in the shaft fixing support (21); and a synthetic resin mold member (90) formed with a first synthetic resin mold (91) around an outer side of the shaft fixing support (21) and around the shaft (30), and a second synthetic resin mold (92) around an outer side of the rotor (50), wherein the rotor core (51) is insertedly fixed in a rotation shaft (44) installed in a lower part of a cylindrical reinforcing part (43) downwardly integrated to a lower part of the impeller (40), and the magnet (52) is installed at certain intervals on a circumferential surface of the rotor core (51) while wrapping and fixing the magnet (52) with the second synthetic resin mold (92), so as to combine the impeller (40) and the rotor (50).

2. The water pump of claim 1, wherein the upper side of the shaft (30) is insertedly fixed in an insertion hole (81') of a middle insertion part (81) of the shaft upper part fixing support member (80) while a lower side of the shaft (30) is insertedly fixed in the shaft fixing support (21).

3. The water pump of claim 1, wherein the shaft upper part fixing support member (80) comprises:

a middle insertion part (81) formed with an insertion hole (81') in the center and downwardly prolonged;

a reinforcing piece (82) installed at certain intervals around an upper part of the middle insertion part (81);

an insertion ring frame (83) integrally formed by connecting the outer side of each reinforcing piece (82); and a fluid passing hole (84) between the reinforcing piece (82) and the reinforcing piece (82).

4. The water pump of claim 3, wherein an edge of the insertion ring frame (83) is fixedly installed by being inserted in an inner side step (11') of the inlet (11).

5. The water pump of claim 1, wherein the water pump is configured by combining an insertion groove (44') of a concavo-convex shape formed on a circumferential surface of the rotation shaft (44) of the impeller (40) and an insertion protrusion (51') of a concavo-convex shape formed inside the rotor core (51) with each other.

6. A water pump (100), comprising:

an upper housing (10) formed with an inlet (11) and an outlet (12) of fluid;

a lower housing (20) installed to fit in a lower side of the upper housing (10), having a receiving space formed therein; a shaft fixing support (21) having a lower part of a protrudedly formed shaft (30) inserted in the center of a bottom part of the lower housing (20);

an impeller (40) installed around the shaft (30);

a rotor (50) configured by having a magnet (52) installed around a rotor core (51);

a stator (60) installed inside the lower housing (20);

a lower cover (70);

a shaft upper part fixing support member (80) installed in an upper side of the shaft (30) erectedly inserted in the shaft fixing support (21); and a synthetic resin mold member (90) formed with a first synthetic resin mold (91) around an outer side of the shaft fixing support (21) and around the shaft (30), and a second synthetic resin mold (92) around an outer side of the rotor (50), wherein the water pump is configured by combining an insertion groove (44') of a concavo-convex shape formed on a circumferential surface of a rotation shaft (44) of the impeller (40) and an insertion protrusion (51') of a concavo-convex shape formed inside the rotor core (51) with each other.

* * * * *